US006494448B2

(12) United States Patent
Duhamel et al.

(10) Patent No.: US 6,494,448 B2
(45) Date of Patent: Dec. 17, 2002

(54) PADDLE WHEEL ARRANGEMENT FOR FLAT COPIES

(75) Inventors: Claude Duhamel, Mogneville (FR); Serge Lanvin, Cires les Mello (FR); Philippe Robin, Cires les Mello (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 82 days.

(21) Appl. No.: 09/789,795

(22) Filed: Feb. 20, 2001

(65) Prior Publication Data

US 2001/0020768 A1 Sep. 13, 2001

(30) Foreign Application Priority Data

Feb. 18, 2000 (DE) ..... 100 07 548
Jul. 10, 2000 (FR) ..... 00 08973

(51) Int. Cl.[7] ..... A24F 15/04
(52) U.S. Cl. ..... 271/187; 271/187
(58) Field of Search ..... 271/187, 315, 271/216, 149

(56) References Cited

U.S. PATENT DOCUMENTS 4,357,008 A * 11/1982 Campbell ..... 271/187
4,522,387 A 6/1985 Leuthold
4,925,179 A * 5/1990 Breton et al. ..... 271/187
5,125,643 A 6/1992 Chung et al.
5,125,645 A 6/1992 Eberle
5,156,389 A 10/1992 Novick
5,611,530 A 3/1997 Maresse et al.
5,975,525 A 11/1999 Hartmann et al.

FOREIGN PATENT DOCUMENTS

JP 61-114958 * 6/1986 ..... B65H/29/40

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

A paddle wheel delivery for flat copies, which are delivered onto a belt surface of a delivery belt, the paddle wheel delivery including at least one paddle wheel formed of two paddle wheel disks mutually adjustable relative to one another. The delivery includes sickle-shaped regions inwardly movable by a relative movement of the paddle wheel disks, for converting a first pocket width of the paddle wheel pockets on the paddle wheels into a second pocket width of the paddle wheel pockets. Also included is a folder including the paddle wheel delivery; and a web-fed rotary printing machine including the paddle wheel delivery.

15 Claims, 2 Drawing Sheets

PADDLE WHEEL ARRANGEMENT FOR FLAT COPIES

BACKGROUND OF THE INVENTION

Field of the Invention

The invention relates to a paddle wheel arrangement for flat copies, the paddle wheel arrangement being provided in folders installed downline from web-processing rotary printing machines.

The published European Patent Document EP 0 408 902 B1 is concerned with a device for delivering printed products. A rotatively driven paddle wheel is provided in a printing machine, to which there is assigned a wheel-shaped ejecting device which is mounted eccentrically with respect to the paddle wheel and is drivable in the same direction of rotation as and at a lower circumferential speed than the paddle wheel. Stops are provided on the circumference of the ejecting device. Through the intermediary of the stops, the printing products which have been fired into the pockets of the paddle wheel and, as a consequence of the relative speed between the stops and the pockets, have initially run up onto the stops, are ejected from the pockets at prescribed intervening distances. The number of effectively ejecting stops is variable.

U.S. Pat. No. 5,125,643 discloses a device for delivering printing products. In this configuration, paddle wheels have two ejector wheels assigned thereto which are positionable relative to one another in circumferential direction. The ejector wheels have a sawtooth profile. If the stops generating a sawtooth profile on the circumference of the ejector wheels are twisted relative to one another by half the width of the stop in the circumferential direction, a regular shingle-stream spacing for successive copies can be set in this paddle wheel arrangement. If the two ejector wheels, by contrast, are set exactly in phase with one another, each pair of copies ejected from the pockets of the paddle wheels will be superimposed and form an overlapping or shingle-stream flow of the copies on the delivery belt wherein, respectively, each pair of exactly superimposed copies will be delivered at a regular spacing or distance from the preceding pair of exactly superimposed copies.

U.S. Pat. No. 5,156,389 is concerned with a paddle wheel delivery system with format-dependently adjustable copy guides, which are respectively provided on outermost paddle wheel disks and on one or more central paddle wheel disks arranged between the outer paddle wheel disks. With these pivotably arranged product guides, the copy delivery system can be adapted to each of various copy widths, respectively, which are to be processed.

SUMMARY OF THE INVENTION

Starting from the foregoing state of the prior art, it is an object of the invention to adapt or match the geometries of paddle wheel pockets, wherein flat copies of different page counts and grammages are received, to the particular nature of the copies to be delivered.

With the foregoing and other objects in view, there is provided, in accordance with one aspect of the invention, a paddle wheel delivery for flat copies, which are delivered onto a belt surface of a delivery belt, the paddle wheel delivery including at least one paddle wheel formed of two paddle wheel disks mutually adjustable relative to one another, comprising sickle-shaped regions inwardly movable by a relative movement of the paddle wheel disks, for converting a first pocket width of the paddle wheel pockets on the paddle wheels into a second pocket width of the paddle wheel pockets.

In accordance with another feature of the invention, the paddle wheel delivery includes a locking device provided between the paddle wheel disks.

In accordance with a further feature of the invention, the locking device serves for locking the paddle wheel disks relative to one another in a circumferential position corresponding to the first pocket width.

In accordance with an added feature of the invention, the locking device serves for locking the paddle wheel disks relative to one another in a circumferential position corresponding to the second pocket width.

In accordance with an additional feature of the invention, the paddle wheel disks are coaxially mounted on a drive shaft.

In accordance with yet another feature of the invention, the paddle wheel delivery includes ejector elements assigned to the pockets, the ejector elements being movable relative to the pockets.

In accordance with yet a further feature of the invention, the ejector elements are movable along a rotational path.

In accordance with yet an added feature of the invention, the rotational path extends about a drive shaft whereon the paddle wheel disks are coaxially mounted.

In accordance with yet an additional feature of the invention, the paddle wheel delivery includes, in the circumferential position of the paddle wheel disks relative to one another, which corresponds to the first pocket width, a following surface of the paddle wheel pockets, which is formed by the paddle wheel disks positioned in phase.

In accordance with still another feature of the invention, the paddle wheel delivery includes, in the circumferential position of the paddle wheel disks relative to one another, which corresponds to the second pocket width, a following surface of the paddle wheel disks narrowed by the sickle-shaped region.

In accordance with still a further feature of the invention, one of the paddle wheel disks has a diameter exceeding the diameter of the other paddle wheel disk.

In accordance with still an added feature of the invention, the locking device includes a latching element prestressed by a prestressing element.

In accordance with still an additional feature of the invention, the paddle wheel delivery includes surfaces defining the paddle wheel pockets of the paddle wheels, the surfaces being provided with a friction-reducing coating.

In accordance with another aspect of the invention, there is provided a folder having a paddle wheel delivery for flat copies, which are delivered onto a belt surface of a delivery belt, the paddle wheel delivery including at least one paddle wheel formed of two paddle wheel disks mutually adjustable relative to one another, comprising sickle-shaped regions inwardly movable by a relative movement of the paddle wheel disks, for converting a first pocket width of the paddle wheel pockets on the paddle wheels into a second pocket width of the paddle wheel pockets.

In accordance with a concomitant aspect of the invention, there is provided a web-fed rotary printing machine having a paddle wheel delivery for flat copies, which are delivered onto a belt surface of a delivery belt, the paddle wheel delivery including at least one paddle wheel formed of two paddle wheel disks mutually adjustable relative to one another, comprising sickle-shaped regions inwardly movable by a relative movement of the paddle wheel disks, for converting a first pocket width of the paddle wheel pockets on the paddle wheels into a second pocket width of the paddle wheel pockets.

The advantages accompanying the construction according to the invention are apparent in that the pocket width of paddle wheel pockets receiving flat copies can be adapted both to the page count of copies to be delivered and to the grammages or basic weights of the respective printing material. The pocket widths of the paddle wheel pockets are narrowed so that the flat copies of printing materials of lower grammage are guided much more tightly by the supporting defining or limiting surface and following surface, i.e., the boundary of the paddle wheel pockets. As a result, fluttering or skewing, and dog-earing of copies of lower basic weights or grammages entering the inwardly running regions of the paddle wheel pockets at high speed, are reliably avoided. This considerably increases the productivity of a web-processing web-fed rotary printing machine, it being immaterial here whether the paddle wheel delivery according to the invention is used in folders with pin systems for the transportation of copies or in pinless folders. As a result of the narrowing of the pocket width of the paddle wheel pockets by a sickle-shaped region defining a second pocket width, the narrowed form of the pocket geometry is constant over the length of the pockets to the base of the pocket, which favorably influences the inward run of the copies.

In a further realization of the concept upon which the invention is based, a locking device is provided between the paddle wheel disks of a paddle wheel. By this locking device, which can be triggered and actuated manually when adjusting the folding mode or by remote control when the rotation is being set, the circumferential position of the first paddle wheel disk relative to the second paddle wheel disk of a particular paddle wheel is defined.

Due to the locking device between the paddle wheel disks lying adjacent and relatively displaceable to one another on a drive shaft, the pocket width can be optimally set for the basic weight or grammage of a first printing material and for one or more further basic weights or grammages of printing materials. As a function of the page count in the copies to be folded, and the grammage of the paper, the pocket widths are so greatly widened or, if appropriate, so greatly narrowed, that a smooth inward run of the current copies into the paddle wheel pockets is assured. The two paddle wheel disks, adjustable relative to one another, are received coaxially on a drive shaft and form a paddle wheel; a plurality of these paddle wheel arrangements can be provided side by side on the drive shaft with uniform spacing.

About the drive shaft, there extends the endless path of rotation of an ejector device, which is formed of an endless belt or chain that runs in-phase relative to the paddle wheel and pushes out from the paddle wheel pockets the copies that have run into each of them when the pocket base meets one of the ejector elements moved in-phase with the paddle wheel.

The relative movement of the paddle wheel disks causes the inward movement of a sickle-shaped region of one of the paddle wheel disks into the pockets of the respective other paddle wheel disk. As a result, the pocket center is reduced from a first pocket width to a second pocket width, so that a narrowing of the curved extent of the pocket towards the pocket base takes place essentially in the central region of the paddle wheel pocket. The pockets of the paddle wheel can thus be individually adapted in their geometries to the printing material of the folded copy.

The locking device between the paddle wheel disks which are adjustable relative to one another may be constructed as a spring-loaded ball element, which engages in a plurality of latching positions on the circumference of one of the paddle wheel disks and fixes a relative adjustment of the paddle wheel disks to one another after one has been selected. The latching devices may correspond to two or more pocket widths that can be preselected in accordance with the grammage of the printing material. These can either be preset manually or be set for a specific job in the course of the remote-controlled presetting.

The paddle wheel arrangement according to the invention may be used on folders with or without sets of pins for fixing the copies, which are installed downline of web-fed rotary printing machines, whether they be jobbing or newspaper printing machines.

Other features which are considered as characteristic for the invention are set forth in the appended claims.

Although the invention is illustrated and described herein as embodied in a paddle wheel device for flat copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
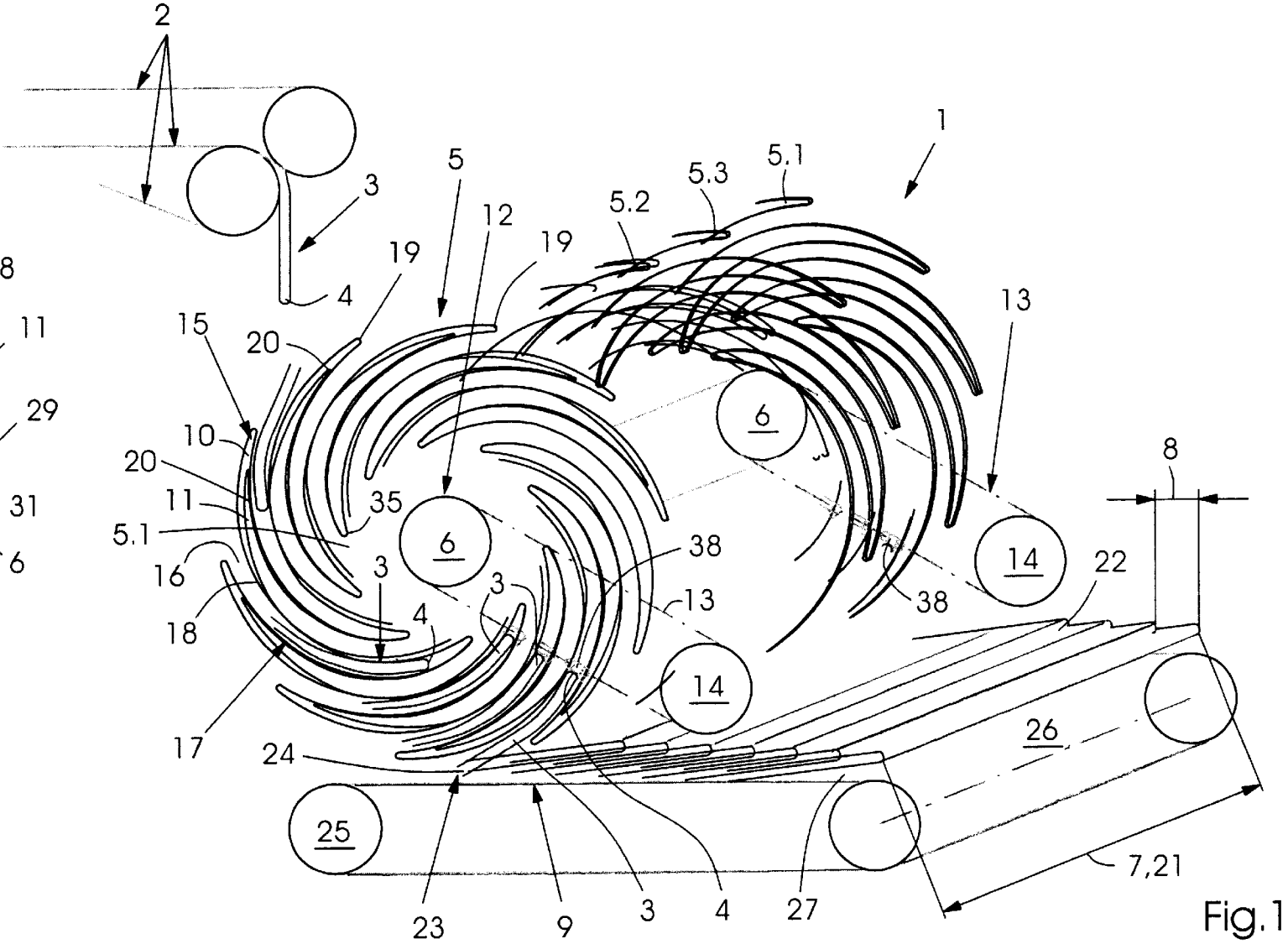
FIG. 1 is a diagrammatic side elevational view of a paddle wheel device having a plurality of paddle wheels disposed above a conveyor belt.

Referring now to the drawings and, first, particularly to FIG. 1 thereof, there is shown therein, in a side elevational view, a paddle wheel device having a plurality of paddle wheels disposed above a conveyor belt for removing ejected copies.

Flat copies 3 are fed via a conveyor belt section 2 to a paddle wheel delivery 1. The flat copies 3 are conveyed in the conveyor belt section 2 with the spine 4 extending forward, and the open end 24 following. The conveyor belt section 2 terminates above the paddle wheel delivery 1 and feeds the copies 3 to the paddle wheels 5.1, 5.2 and 5.3 mounted in common on a drive shaft 6. Depending upon the maximum copy format that can be processed, it is also possible for more than four or fewer than four paddle wheels 5 to be mounted mutually adjacently at spaced distances on the drive shaft 6.

During entry of the copies 3 into the respective paddle wheel pocket 15, the respective copy 3 is braked and, during the further rotation of the paddle wheel 5, moved out from the paddle wheel pocket 15 due to contact with the ejector element 38 which is driven in phase. Contrary to the original direction of entry thereof into the individual paddle wheel pockets 15, the copies 3 arrive on the top 27 of a delivery belt 9 with the open ends 24 of the copies 3 leading. An overlapping flow or shingle stream of copies 3 is formed thereat, a spaced distance 8 being created between the spines 4 of the individual copies 3. The copies 3 extend over the width 7, 21 from one side of the delivery belt 9 to the opposite side.

Ejection of the copies 3 that have entered the individual paddle wheel pockets 15 is performed by individual ejector elements 38 which are mounted on a belt or chain revolving around the drive shaft 6 and a deflection shaft 14 and, during further rotation of the paddle wheel 5.1 with the drive shaft 6, cause ejection of the copies 3 from the paddle wheel pocket 15. For this purpose, the spine 4 comes into contact with the ejector elements 38, as a result of which the copies 3, during the further rotation of the paddle wheel disks 10 and 11 about the drive shaft 13 thereof, are pushed out of the pocket 15 in a direction opposite to the direction of rotation of the paddle wheel 5.1. In the embodiment shown in FIG. 1, the pockets 15 are set to a first pocket width 16, i. e., the two paddle wheel disks 10 and 11 are exactly in phase with one another, as can be seen from the mutually flush paddle blade tips 19 and 20 in FIG. 1.

In FIG. 1, the first paddle wheel disk 10 of the paddle wheel 5.1 has a larger diameter in comparison with the second paddle wheel disk 11; a reversed diametric ratio would also be conceivable. The copies 3 running into the paddle wheel 5.1 and leaving the conveyor belt section 2 are supported by a bearing surface 17 of the respective paddle wheel pocket 15. The paddle wheel pocket 15 is limited on the opposite side by a following surface 18. In the exemplary embodiment shown, the bearing surfaces 17 and the following surface 18 of each paddle wheel disk 10, 11 are exactly in phase and thus define a first pocket width 16 for copies 3 of greater grammage or higher page count The individual copies 3 ejected from the paddle wheel pockets 15 arrive on the top 27 of the delivery belt 9, which runs around deflection rollers 25 and 26. The copies 3 arriving on the top 27 of the delivery belt 9 are continuously conveyed onward with the spines 4 leading, and fed to an adjoining further processing station.

In order to facilitate the entry of the folded copies 3 into the pockets 15 of the paddle wheel 5.1, the bearing surface 17 and the following surface 18 may each be provided with friction-reducing coatings which prevent a deposition of ink from the top and bottom page 22, respectively, of the copies 3.

Figure 2:
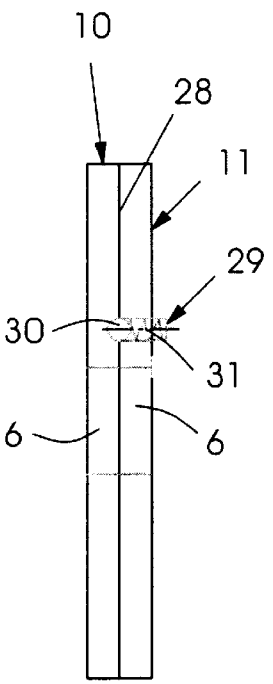
FIG. 2 is a front elevational view of FIG. 1 showing a pair of paddle wheel disks with a locking device.

FIG. 2 is a front elevational view of a paddle wheel formed of two paddle wheel disks.

The two paddle wheel disks 10 and 11, shown here with identical diameters, rest upon one another at a contact surface 28 and can be permanently set in the respective circumferential position relative to one another by a locking device 28, shown here diagrammatically. The locking positions, wherein a spring-loaded spherical element 30 engages in recesses formed in the opposite cam disk 10 and 11, respectively, correspond to a first pocket width 16 to be set, to a second pocket width 32 to be set (note FIG. 3) and, optionally, to further pocket widths, each of which can be set at the paddle wheel pockets 15. The pocket widths 16, 32 and any other pocket widths to be preset are adapted to copies of printing material of higher or lower grammage, or to copies with higher or lower page counts. The copy delivery system 1 can thus advantageously be optimally adjusted to the characteristics of the respective copies 3 to be delivered. The spherical latching element 30 of the paddle wheel disks 10 and 11, which serves as a locking device 28, can be positioned either manually or by remote control during presetting, so that the pocket width is already preset for specific jobs in the course of setting up for a printing job to be printed. The two paddle wheel disks 10 and 11 are provided with holes through which there extends the drive shaft 6 whereon a plurality of paddle wheel devices 5 can be mounted.

Figure 3:
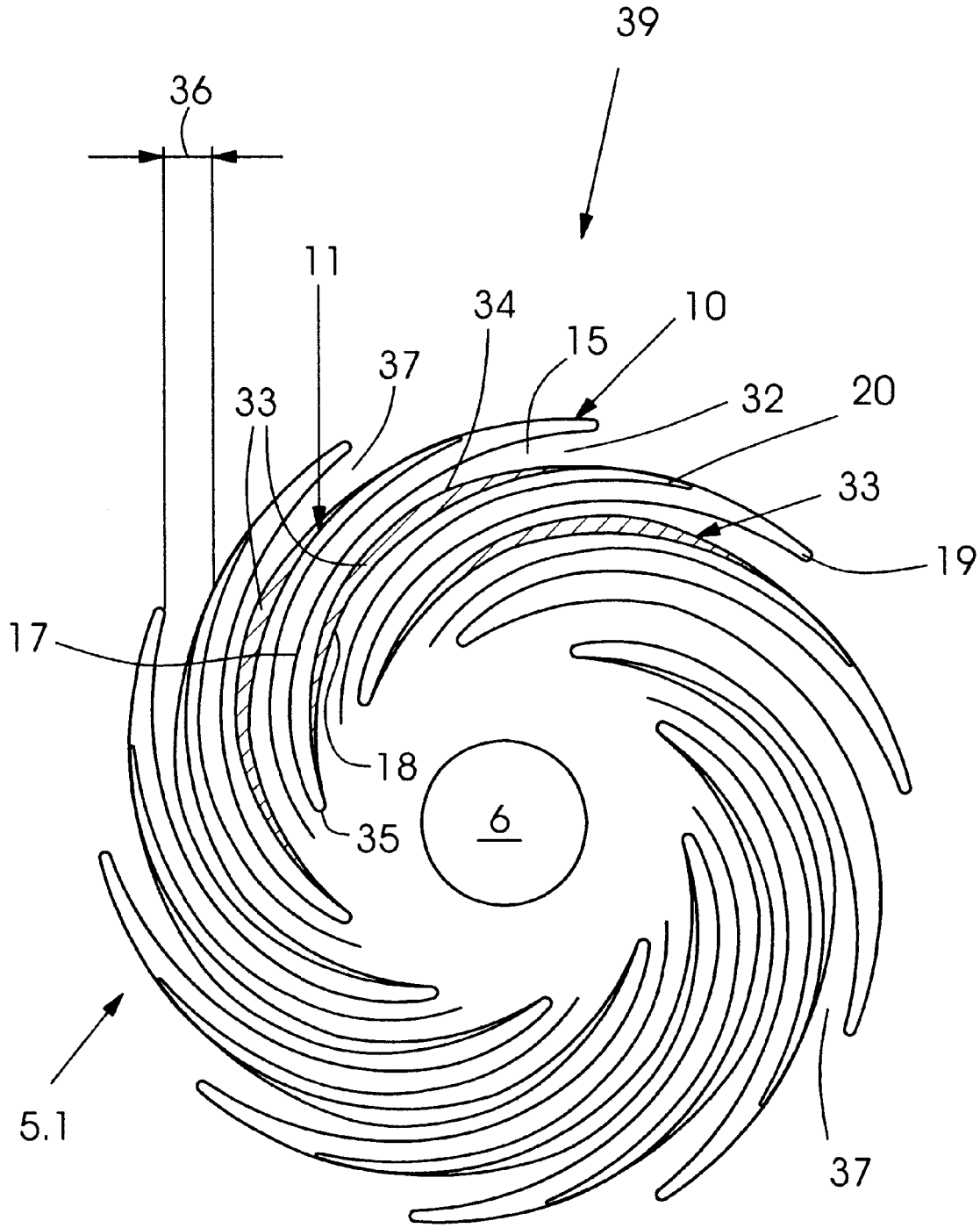
FIG. 3 is an enlarged fragmentary view of FIG. 1 showing a circumferential setting of the pair of paddle wheel disks with paddle wheel pocket widths narrowed by sickle-shaped regions which have been moved into the paddle wheel pockets.

FIG. 3 shows the circumferential position, corresponding to a second pocket width, of a pair of paddle wheel disks relative to one another.

In the illustration according to FIG. 3, which corresponds to a circumferential position or setting 39 of the paddle wheel disks 10 and 11 relative to one another, a second pocket width 32 is set at the paddle wheel pockets 15. The two paddle wheel disks 10 and 11 are adjusted relative to one another in the circumferential direction on the drive shaft 6 so that the paddle wheel pockets 15 are narrowed by respective regions 33 shown with hatched lines. These regions 33, extending in the shape of a sickle, form a second following surface 34 at the pockets 15 of the paddle wheel device 5 and enter into the pockets 15 in a manner that they project over the trailing edge 18 (note FIG. 1) and considerably narrow the central region of the respective paddle wheel pockets 15, the course of which is curved in somewhat of the shape of a sabre. As a result, the geometry of the respective inwardly-running regions 37 on the individual pockets 15 changes; the changed circumferential position which the paddle wheel disks 10 and 11 adopt relative to one another can also be seen from the fact that the blade tips 19 and 20 lie farther apart in the circumferential direction.

The inward movement of the hatched regions 33 into the individual pockets 15 caused by the relative twisting of the two paddle wheel disks 10 and 11 in the circumferential direction prevents dog-earing of thin and light-weight copies 3, when these enter the respective paddle wheel pockets 15 at high speed, i.e., with high kinetic energy.

The individual paddle wheels 5.1, which are arranged on the common drive shaft 6, may be produced from plastic material and provided with friction-reducing coatings. In addition, it is also possible to make the individual paddle wheel disks 10 and 11 of metal; the sabre-shaped extent of the curvature of the pockets 15 towards the pocket base 35 both permits a reduction in kinetic energy at high entry speeds of the copies 3, thus reducing the impact of the spine 4 in the pocket base 35, and is also suitable for receiving a wide variety of cut-off lengths of the copies 3 and can thus be universally used without any need for making any adjustments.

The larger the original pocket width 15 selected at the paddle wheel disks 10 and 11 is, the more latching positions in the circumferential direction can be provided on the locking device 28; a paddle wheel 5 constructed in this manner can be set not only to a second pocket width 32 but also to further pocket widths wherein a correspondingly wide or less wide introduction of the sickle-shaped region 33, shown in hatched lines in FIG. 3, into the pocket 15 can take place.

We claim:

1. A paddle wheel delivery for flat copies, which are delivered onto a belt surface of a delivery belt, the paddle wheel delivery including at least one paddle wheel formed of two paddle wheel disks mutually in direct contact at their outer peripheries and adjustable relative to one another about a common axis, comprising sickle-shaped regions inwardly movable by a relative movement of the paddle wheel disks, for converting a first pocket width of the paddle wheel pockets on the paddle wheels into a second pocket width of the paddle wheel pockets.

2. The paddle wheel delivery according to claim 1, wherein the paddle wheel disks are coaxially mounted on a drive shaft.

3. The paddle wheel delivery according to claim 1, wherein one of the paddle wheel disks has a diameter exceeding the diameter of the other paddle wheel disk.

4. The paddle wheel delivery according to claim 1, including surfaces defining the paddle wheel pockets of the paddle wheels, said surfaces being provided with a friction-reducing coating.

5. The paddle wheel delivery according to claim 1, including ejector elements assigned to the pockets, said ejector elements being movable relative to the pockets.

6. The paddle wheel delivery according to claim 5, wherein said ejector elements are movable along a rotational path.

7. The paddle wheel delivery according to claim 6, wherein said rotational path extends about a drive shaft whereon the paddle wheel disks are coaxially mounted.

8. The paddle wheel delivery according to claim 1, including a locking device provided between the paddle wheel disks.

9. The paddle wheel delivery according to claim 8, wherein said locking device includes a latching element prestressed by a prestressing element.

10. The paddle wheel delivery according to claim 8, wherein said locking device serves for locking the paddle wheel disks relative to one another in a circumferential position corresponding to the first pocket width.

11. The paddle wheel delivery according to claim 10, which includes, in said circumferential position of the paddle wheel disks relative to one another, which corresponds to the first pocket width, a following surface of the paddle wheel pockets is formed by the paddle wheel disks positioned in phase.

12. The paddle wheel delivery according to claim 8, wherein said locking device serves for locking the paddle wheel disks relative to one another in a circumferential position corresponding to the second pocket width.

13. The paddle wheel delivery according to claim 4, which includes, in said circumferential position of the paddle wheel disks relative to one another, which corresponds to the second pocket width, a following surface of the paddle wheel disks is narrowed by said sickle-shaped region.

14. A folder having a paddle wheel delivery for flat copies, which are delivered onto a belt surface of a delivery belt, the paddle wheel delivery including at least one paddle wheel formed of two paddle wheel disks mutually in direct contact at their outer peripheries and adjustable relative to one another about a common axis, comprising sickle-shaped regions inwardly movable by a relative movement of the paddle wheel disks, for converting a first pocket width of the paddle wheel pockets on the paddle wheels into a second pocket width of the paddle wheel pockets.

15. A web-fed rotary printing machine having a paddle wheel delivery for flat copies, which are delivered onto a belt surface of a delivery belt, the paddle wheel delivery including at least one paddle wheel formed of two paddle wheel disks mutually in direct contact at their outer peripheries and adjustable relative to one another about a common axis, comprising sickle-shaped regions inwardly movable by a relative movement of the paddle wheel disks, for converting a first pocket width of the paddle wheel pockets on the paddle wheels into a second pocket width of the paddle wheel pockets.

* * * * *